US009163596B2

(12) United States Patent
Fisher et al.

(10) Patent No.: US 9,163,596 B2
(45) Date of Patent: Oct. 20, 2015

(54) THERMAL RECIRCULATION VALVE FOR FUEL FILTRATION MODULE

(71) Applicant: CUMMINS FILTRATION IP, INC., Minneapolis, MN (US)

(72) Inventors: Andrew J. Fisher, Cookeville, TN (US); Eric R. Burgan, Baxter, TN (US); J Bradley Groom, Connersville, IN (US)

(73) Assignee: Cummins Filtration IP, Inc., Columbus, IN (US)

( * ) Notice: Subject to any disclaimer, the term of this patent is extended or adjusted under 35 U.S.C. 154(b) by 309 days.

(21) Appl. No.: 13/927,258

(22) Filed: Jun. 26, 2013

(65) Prior Publication Data

US 2014/0000727 A1 Jan. 2, 2014

Related U.S. Application Data

(60) Provisional application No. 61/664,957, filed on Jun. 27, 2012.

(51) Int. Cl.
*F02M 37/22* (2006.01)
*F02M 37/00* (2006.01)

(52) U.S. Cl.
CPC ..... *F02M 37/0035* (2013.01); *F02M 37/0052* (2013.01); *F02M 37/22* (2013.01); *Y10T 137/7737* (2015.04)

(58) Field of Classification Search
CPC ..... F02M 37/0035; F02M 37/0052; F02M 37/22; Y10T 137/7737; G05D 23/02; G05D 23/021; G05D 23/022
USPC ..... 236/93 A, 99 R, 99 J, 99 K; 127/514
See application file for complete search history.

(56) References Cited

U.S. PATENT DOCUMENTS

| | | | | |
|---|---|---|---|---|
| 4,452,213 | A † | 6/1984 | Duprez | |
| 5,832,902 | A * | 11/1998 | Davis et al. | 123/514 |
| 5,887,573 | A * | 3/1999 | Janik et al. | 123/514 |
| 6,289,879 | B1 † | 9/2001 | Clausen | |
| 2002/0074419 | A1 | 6/2002 | Duffer et al. | |
| 2007/0062494 | A1 | 3/2007 | Yanagi et al. | |
| 2009/0277424 | A1 | 11/2009 | Yonemoto et al. | |
| 2010/0186831 | A1 * | 7/2010 | Roman et al. | 137/468 |

FOREIGN PATENT DOCUMENTS

| | | |
|---|---|---|
| EP | 2 402 586 | 1/2012 |
| KR | 101075796 | 10/2011 |

OTHER PUBLICATIONS

International Preliminary Report on Patentability and Written Opinion of the International Searching Authority issued for PCT/US2013/047585, dated Dec. 31, 2014.

* cited by examiner
† cited by third party

*Primary Examiner* — Marc Norman
(74) *Attorney, Agent, or Firm* — Foley & Lardner LLP

(57) ABSTRACT

A thermal recirculation valve (TRV) is described that provides for effective fuel module heating during cold operation to mitigate fuel waxing or gelling issues. The TRV allows for the control of heated return fuel flow into the module dependent upon the module's outlet fuel temperature without the return fuel directly contacting the wax element. The wax element is isolated from direct contact with the higher temperature return fuel through use of an elastomeric seal which prevents return fuel from directly contacting the wax element. In addition, the wax element is positioned in the fuel outlet of the module.

17 Claims, 6 Drawing Sheets

THERMAL RECIRCULATION VALVE FOR FUEL FILTRATION MODULE

FIELD

A thermal recirculation valve (TRV) design is described that offers improved performance due to its unique positioning and internal sealing that allows for high resolution temperature control of the fuel.

BACKGROUND

TRVs are existing components in the market today, but are not optimized for best performance due to common packaging schemes for fuel filtration applications. FIG. 1 illustrates a known TRV. The TRV includes fuel filtration module 1, a fuel filtration module inlet 2, a fuel filtration module outlet 3, a TRV inlet 4, a TRV passage to module 5, a return fuel flow control valve 6, a TRV outlet 7, a thermal wax element 8, and filtration media 9. Fuel entering the inlet 2 is forced to flow through the media 9 before flowing to the outlet 3. Any return fuel that returns through the passage 5 contacts the wax element 8 and then flows through the media 9 to the outlet 3.

In most known applications, the TRV wax elements are positioned such that there is either radiant or conduction heat transfer from the return fuel due to the flow passage design near the sensing region which causes the return fuel to directly contact the wax element. This causes poor performance due to rapid heat transfer to the sensing region location of the wax element, which could cause the valve to prematurely close during cold operating conditions.

SUMMARY

A TRV is described that provides for effective fuel module heating during cold operation to mitigate fuel waxing or gelling issues. Additionally, the TRV provides continuous fuel temperature regulation to reduce the risk of overtemperature fuel delivered to the high pressure pump or other downstream component.

The described TRV allows for the control of heated return fuel flow into the module dependent upon the module's outlet fuel temperature without directly contacting the wax element. This is accomplished through use of an appropriately positioned thermal wax element, along with internal sealing around the return valve. In particular, the wax element's sensing area is isolated from direct return fuel heat transfer through use of an elastomeric seal which prevents return fuel from directly contacting the wax element. This internal sealing method allows only module outlet fuel flow to contact the wax element body which, in turn, emits force to control the return flow valve. In essence, the described TRV offers precise temperature control of the supply fuel that is delivered downstream to, for example, the high-pressure pump.

In one embodiment, a thermal recirculation valve is provided that is mountable on a fuel filtration module having a fuel inlet and a fuel outlet. The thermal recirculation valve includes a valve housing with a thermal recirculation valve inlet formed in the valve housing that in use receives heated fuel from an engine and a thermal recirculation valve outlet formed in the valve housing that is fluidly connected to the thermal recirculation valve inlet via a first fluid passage and that in use is fluidly connected to a fuel tank. In addition, a fuel return passage is formed in the valve housing, with the fuel return passage having a fuel return passage inlet and a fuel return passage outlet. The fuel return passage inlet is fluidly connected to the first fluid passage, the fuel return passage inlet includes a valve seat, and in use the fuel return passage outlet is fluidly connected to the fuel outlet of the fuel filtration module. A flow control valve is disposed in the fuel return passage that controls the flow of fuel through the fuel return passage. The flow control valve includes a sealing end, and the flow control valve has a first position where the sealing end is engaged with the valve seat to control the flow of fuel from the first fluid passage into the fuel return passage and a second position where the sealing end is not engaged with the valve seat to permit unrestricted flow of fuel through the fuel return passage inlet from the first fluid passage into the fuel return passage and to the fuel return passage outlet. In addition, a thermal wax element is connected to the flow control valve to move the flow control valve between the first position and the second position. The thermal wax element is positioned so that in use the thermal wax element can be immersed in fuel in the fuel outlet of the filtration module.

In another embodiment, a seal can be provided that seals between the flow control flow valve and the valve housing to prevent fuel in the fuel return passage from contacting the thermal wax element.

In another embodiment, the thermal recirculation valve is used in combination with a fuel filtration module having a fuel inlet, a fuel outlet, and a filter element that filters fuel as it flows from the fuel inlet to the fuel outlet. The fuel return passage outlet of the thermal recirculation valve is fluidly connected to a dirty side of the filter element so that fuel that is returned via the thermal recirculation valve is filtered and mixes with the fuel in the fuel filtration module before the return fuel reaches the fuel outlet and contacts the thermal wax element.

DRAWINGS

DETAILED DESCRIPTION

With reference to FIGS. 2-6, the system 10 includes a thermal recirculation valve (TRV) 20 mounted on a fuel filtration module 22. The TRV 20 is designed to control the return flow of heated fuel back into the module 22 to increase the temperature of the fuel before the fuel flows from the module 22, thereby providing precise temperature control of the supply fuel that is delivered downstream to the high-pressure pump and/or other downstream components.

The module 22 includes a fuel inlet 12, a fuel outlet 13, and a filter element (not shown) that filters fuel as it flows from the fuel inlet 12 to the fuel outlet 13. In use, the module 22 forms part of a fuel supply system of an engine. The fuel inlet 12 is fluidly connected to a fuel tank or other fuel supply, and the fuel outlet 13 is fluidly connected to a high-pressure pump or other downstream component that receives fuel from the module 22. The filter element can be part of a spin-on filter assembly that is periodically removed and discarded at determined service intervals, or is removably disposed within a re-usable housing with the housing being removed and the filter element thereafter removed and replaced with a new filter element. Any type of filter element can be used as long as the filter element is capable of filtering fuel that enters the inlet 12.

Figure 1:
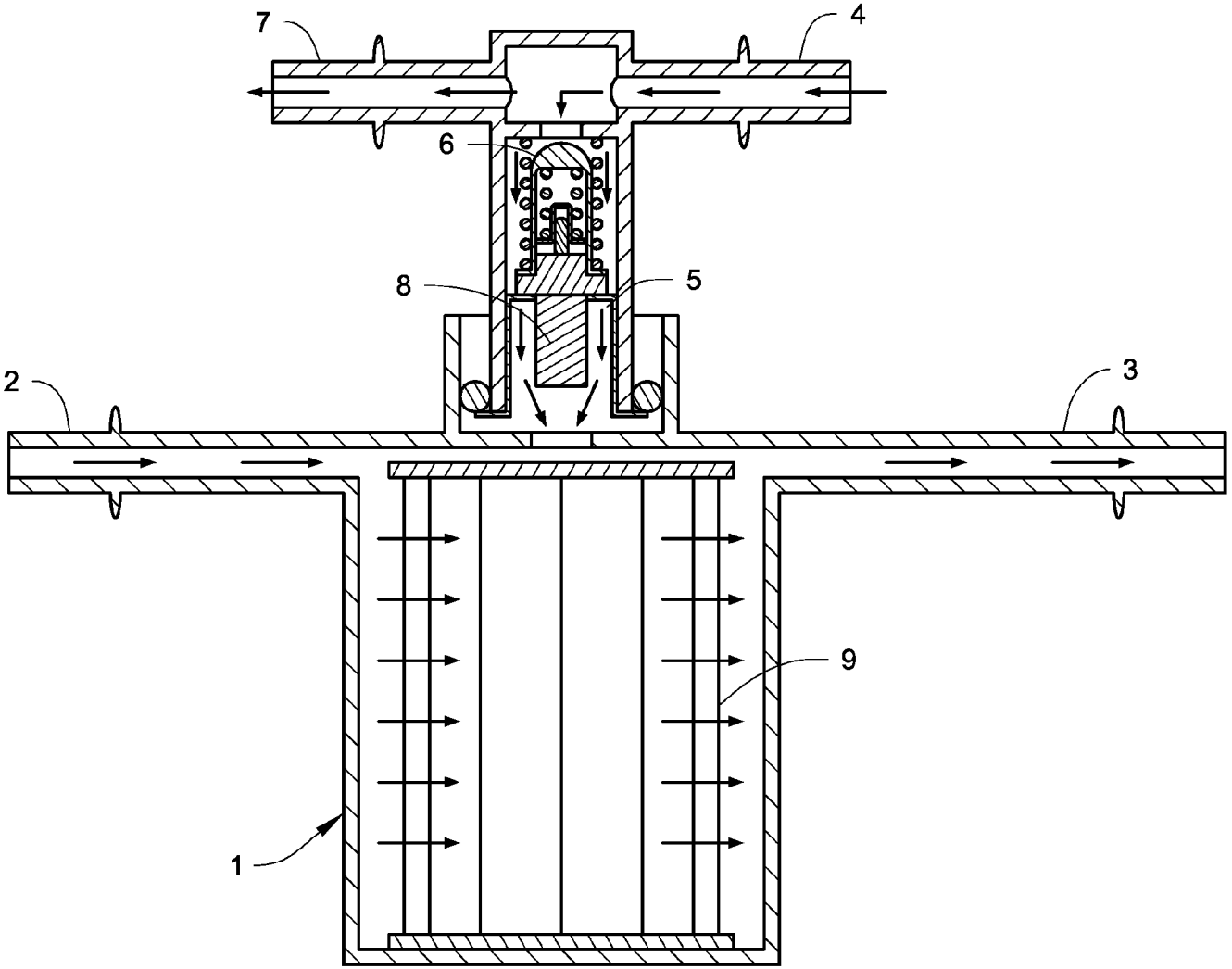
Fig. 1 (Prior Art)
FIG. 1 is a cross-sectional view of a prior art TRV mounted on a fuel filtration module.
Figure 2:
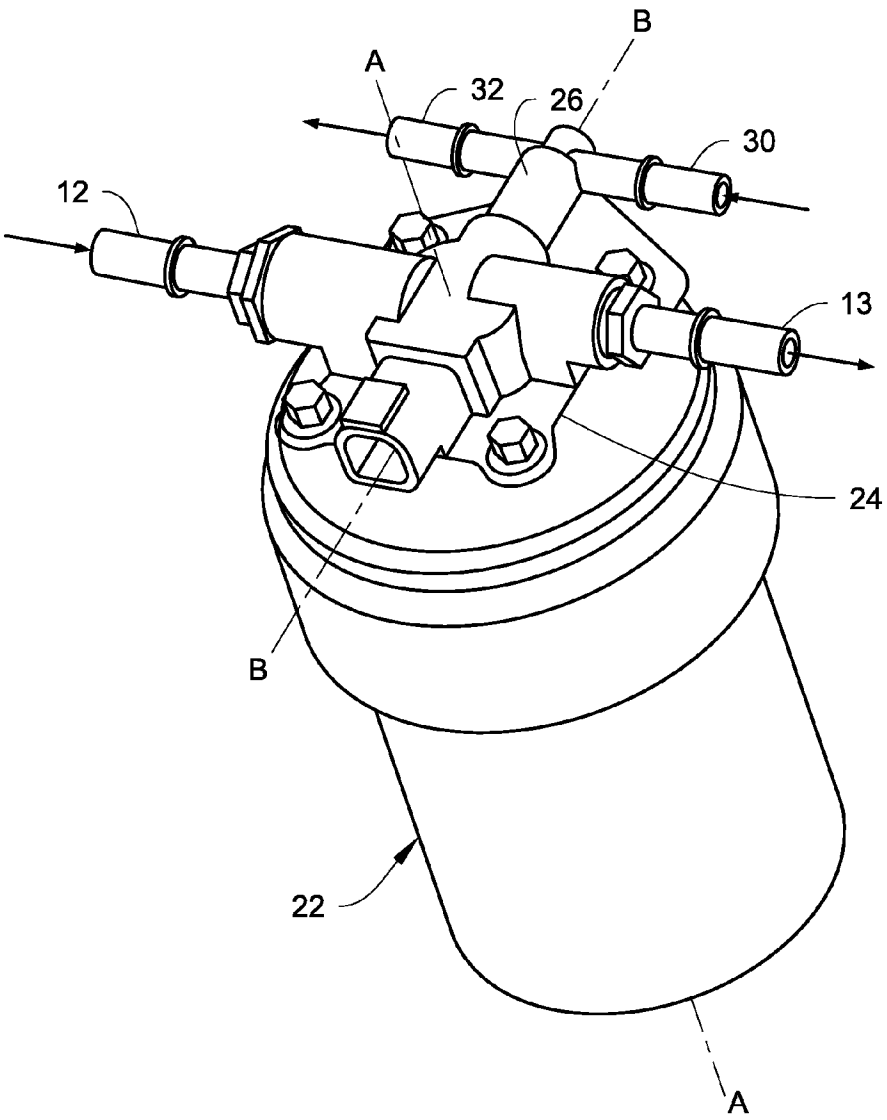
FIG. 2 is a perspective view of the TRV described herein mounted on a fuel filtration module.
Figure 3:
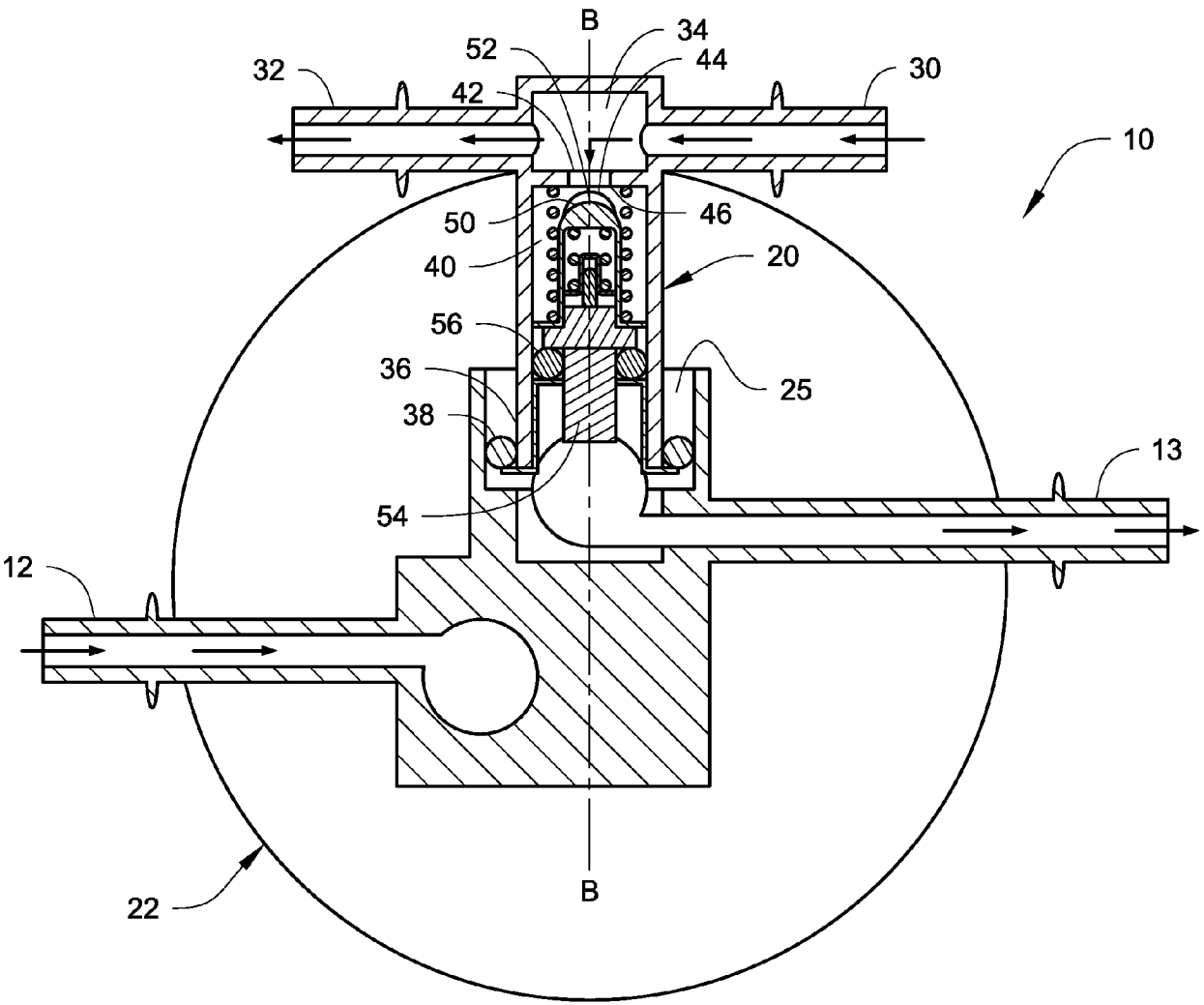
FIG. 3 is a top cross-section view through the TRV and the fuel filtration module of FIG. 2.

As best seen in FIG. 2, the fuel inlet 12 and the fuel outlet 13 are part of a housing assembly 24 that is installed at the top of the module 22. The inlet 12 directs fuel to be filtered to a dirty side of the filter element and the fuel outlet 13 is disposed on a clean fuel side of the filter element and receives filtered fuel. As shown in FIG. 3, the assembly 24 includes a sideways facing opening 25 (i.e. the central axis B-B of the opening 25 is generally perpendicular to a central axis A-A of the filter element). The opening 25 is in fluid communication with the fuel outlet 13.

The TRV 20 is an assembly that is also mounted at the top of the module and that interfaces with the assembly 24. In particular, the TRV 20 includes a valve housing 26 that is fixed to the top of the module via flanges 28*a*, 28*b*. The housing 26 includes a TRV inlet 30 formed in the valve housing that in use receives heated fuel from an engine such as the fuel injectors. A TRV outlet 32 is also formed in the valve housing 26 and is fluidly connected to the thermal recirculation valve inlet 30 via a first fluid passage 34 and that in use is fluidly connected to a fuel tank or other fuel supply to be able to return fuel to the fuel tank.

With reference to FIG. 3, an end 36 of the housing 26 is disposed within the opening 25 of the assembly 24, and the end 36 is sealed with the housing 26 by a seal 38, such as an elastomeric o-ring seal. A fuel return passage 40 is formed in the valve housing 26 and includes a fuel return passage inlet 42 and a fuel return passage outlet 44. The fuel return passage inlet 42 is fluidly connected to the first fluid passage 34 and the fuel return passage inlet 42 includes a valve seat 46.

Figure 4:
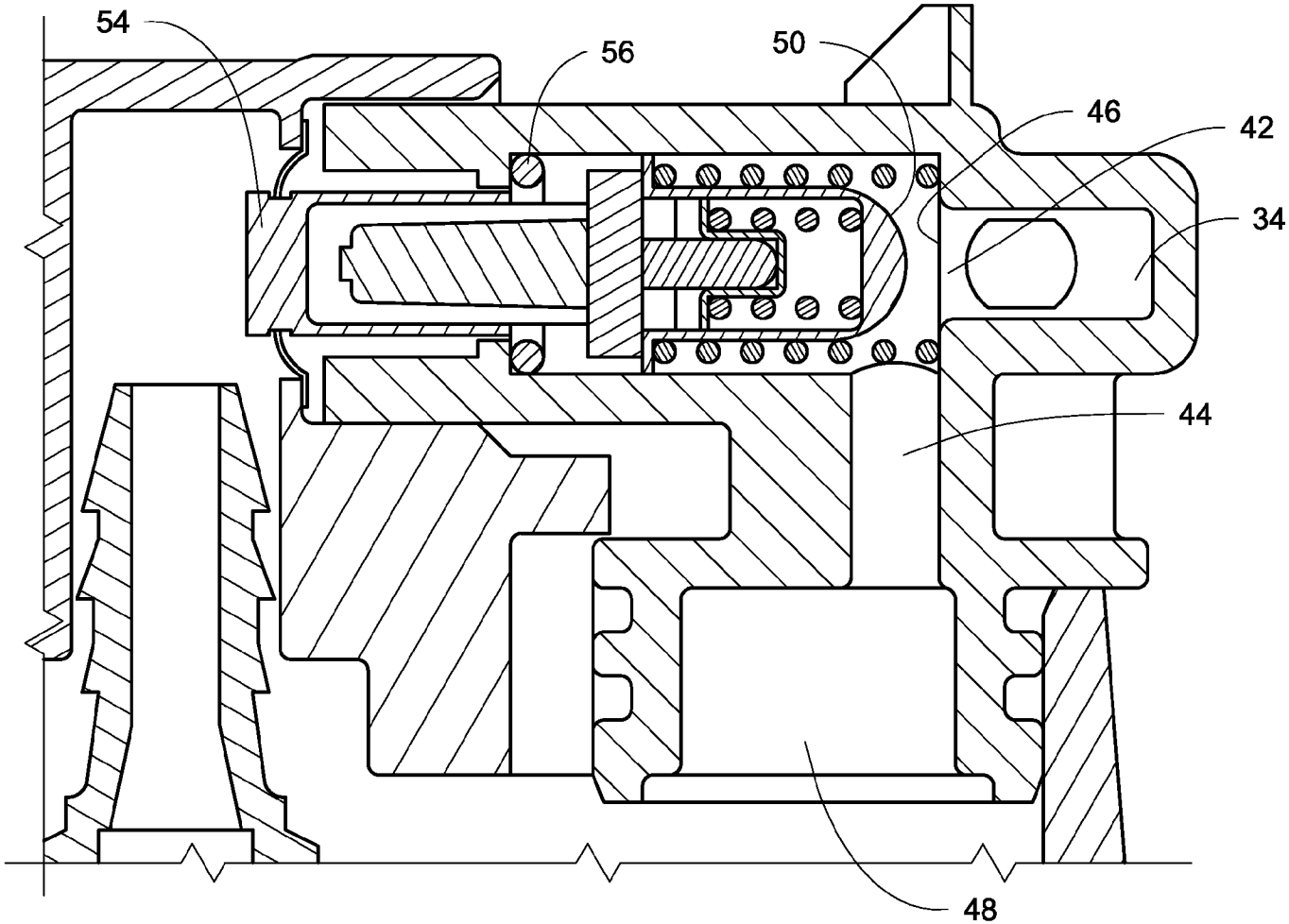
FIG. 4 is side cross-section view through the TRV and a portion of the fuel filtration module.
Figure 5:
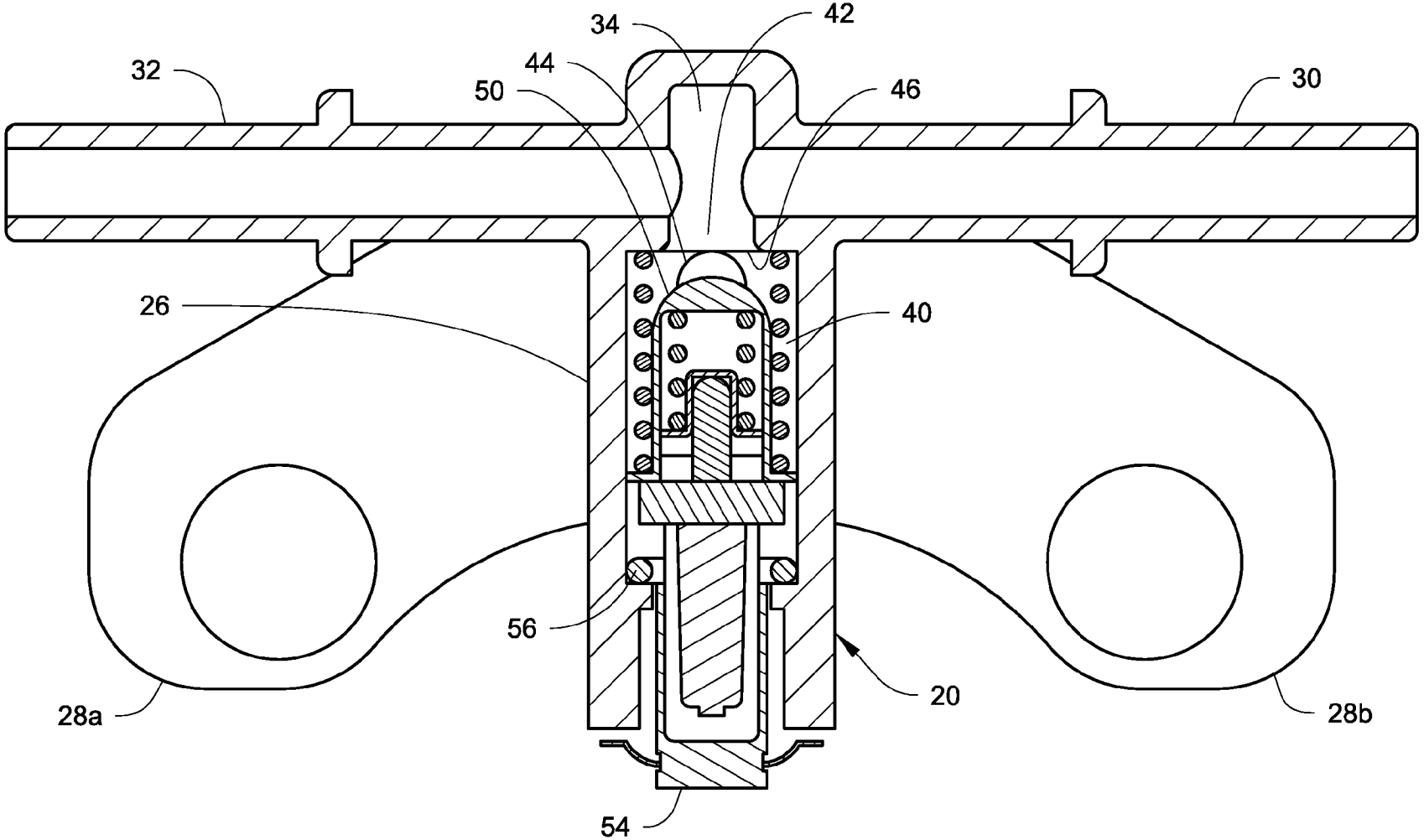
FIG. 5 is a top cross-section view through the TRV.
Figure 6:
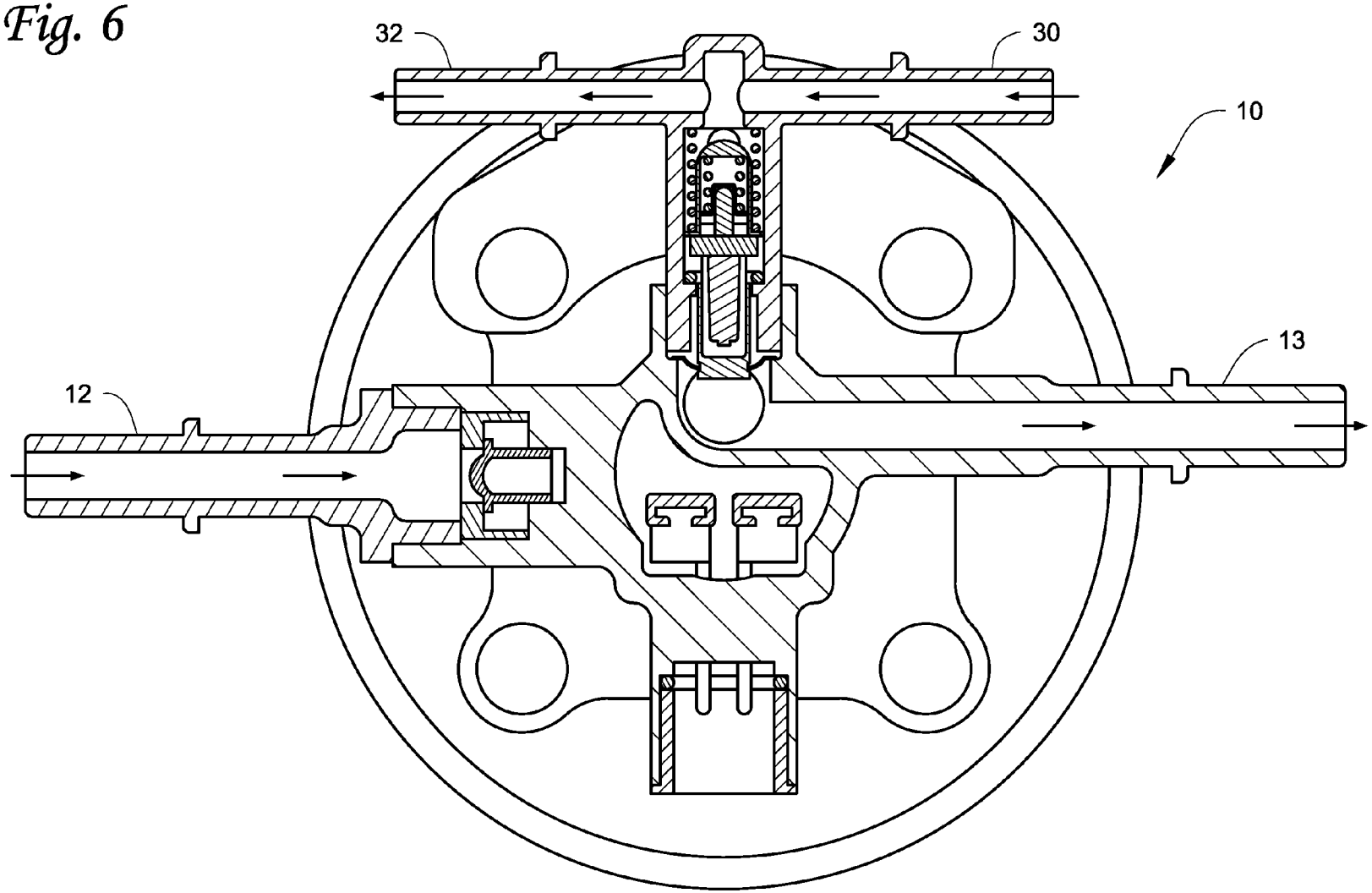
FIG. 6 is a detailed top cross-section view through the TRV and the fuel filtration module of FIG. 2.

In addition, with reference to FIGS. 3 and 4, the fuel return passage outlet 44 is fluidly connected to the fuel outlet 13 of the fuel filtration module 22. In particular, as best seen in FIG. 4, the outlet 44 extends vertically downward at an angle of approximately 90 degrees relative to the inlet 42 (substantially perpendicular to the axis B-B and substantially parallel to the axis A-A) and connects to a fluid passage 48 that fluidly communicates with the dirty side of the filter element of the module 22. Therefore, fuel that flows into the outlet 44 is directed back into the module 22 where it is filtered by the filter element before flowing to the fuel outlet 13. In another embodiment, the return fuel is directed to the clean side, for example directly into the fuel outlet 13.

In an embodiment, the module can include multiple filter elements, for example two filter elements, and the return fuel from the outlet 44 can be introduced into the module so as to be filtered by one or both of the filter elements before flowing to the outlet.

The fuel return passage outlet 44 can be positioned at any suitable location as long as the return fuel can flow back to the module and the return fuel does not directly contact the thermal wax element as described further below. For example, as illustrated in the drawings, the outlet 44 can be described as being located between the first fluid passage 34 and the thermal wax element 54. Also, the fuel return passage outlet 44 can be described as being positioned closer to the fuel return passage inlet 42 than to the thermal wax element.

A flow control valve 50 is disposed in the fuel return passage 40 that controls flow of fuel through the fuel return passage from the fluid passage 34. The flow control valve 50 includes a sealing end 52 and a thermal wax element 54 at the opposite end that is connected to the flow control valve to control the position of the sealing end 52. The general construction of the flow control valve 50 and how the thermal wax element 54 controls the position of the valve is well known in the art.

However, the flow control valve 50 differs from conventional valves used in TRV's in a number of ways. In particular, the thermal wax element 54 is positioned in the fuel outlet 13 of the module 22 so that in use the thermal wax element 54 can be immersed in fuel in the fuel outlet of the module. In addition, the valve 50 extends generally horizontally on the module 22 so that the valve has a longitudinal axis B-B that is substantially perpendicular to the longitudinal axis A-A of the module 22 and the filter element.

Also, a seal 56 is provided that seals between the flow control valve 50 and the valve housing 26 to prevent fuel in the fuel return passage 40 from directly contacting the thermal wax element 54. In the illustrated example, the seal is an elastomeric o-ring seal, disposed on the flow control valve between the sealing end 52 and the thermal wax element 54, in particular disposed between the outlet 44 and the thermal wax element 54. In one embodiment, the seal 56 is designed to prevent substantially all fuel from flowing past the seal 56 and directly contacting the thermal wax element 54. In another embodiment, an amount of fuel, but a relatively insignificant amount, could be allowed to flow or leak past the seal 56 in order to contact the thermal wax element 54.

In operation, the flow control valve 50 has a first position (not shown) where the sealing end 52 is engaged with the valve seat 46 to control the flow of fuel from the first fluid passage 34 into the fuel return passage 40 and a second position (shown in FIGS. 2-6) where the sealing end 52 is not engaged with the valve seat to permit unrestricted flow of fuel through the fuel return passage inlet 42 from the first fluid passage 34 into the fuel return passage 40 and to the fuel return passage outlet 44. As used herein, the phrase "control the flow of fuel" is meant to include substantially complete prevention of fuel flow when the sealing end 52 is engaged with the valve seat 46. So in one embodiment, the flow control valve substantially prevents the flow of fuel from the first fluid passage through the fuel return passage inlet and into the fuel return passage.

During use of the system 10, fuel from the fuel supply enters the fuel filtration module 22 through the fuel inlet 12 and passes through the filtration media. Once the fuel is filtered, it then passes downstream to an additional filtration device(s), or proceeds to the engine's high-pressure pump or other downstream component through the fuel outlet 13.

As this flow through the module 22 is taking place, return fuel from the engine simultaneously enters the TRV inlet 30. The return fuel is allowed to flow either to the fuel filtration module 22 or back to the fuel supply via the TRV outlet 32 dependent upon the position of the flow control valve 50. The flow control valve 50 position is controlled by the thermal wax element 54. The thermal wax element 54 includes a piston that is designed to stroke via force emitted during the expansion of volume within the wax element body and can be designed to move the piston at predetermined temperature values by specially formulated wax blends.

The piston is attached to the sealing end 52 of the fuel control valve 50 that is designed to seat with the valve seat 46 once the valve 50 reached its predetermined full stroke operation temperature (i.e. the first position). In cold operation conditions, the fuel control valve 50 will be in a relaxed state at its second position such that return fuel is able to flow into the fuel filtration module 22 through the fuel return passage 40 to allow for heat transfer from the higher temperature return fuel to the supply fuel that has entered the fuel filtration module 22. This prevents the fuel from becoming "gelled" or "waxed" which could inherently cause poor engine operation.

Because the thermal wax element 54 is exposed to the fuel in the fuel outlet 13, the thermal wax element 54 is heated by (i.e. is exposed to or senses the fuel temperature of) the fuel in the fuel outlet. Once the fuel reaches a predetermined temperature, the thermal wax element 54 will have actuated the flow control valve 50 to an extent such that the sealing end 52 of the valve seats with the valve seat 46 so that most or all of the return fuel flowing into the TRV inlet 30 flows back to the fuel supply through the TRV outlet 32.

The thermal wax element 54 is positioned such that the aforementioned process is completely dependent upon the fuel outlet 13 fuel temperature. The seal 56 prevents the returning fuel from directly contacting the thermal wax element 54. So the flow control valve 50 is prevented from closing prematurely due to rapid heat transfer to the thermal wax element 54 from the returning fuel. Thus, the system 10 provides better temperature regulation of fuel delivered to the downstream filtration device(s) or high-pressure fuel pump.

In addition, unlike the TRV 20, prior art TRV designs are packaged vertically on the fuel filtration module, and allow for direct or radiant return fuel heat transfer to the thermal wax element, causing low resolution return fuel flow control valve position. Additionally, in prior art TRV designs, the thermal wax element is not positioned such that it is continuously immersed in the fuel in the fuel outlet for proper temperature sensing as in the TRV 20.

The invention may be embodied in other forms without departing from the spirit or novel characteristics thereof. The embodiments disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A thermal recirculation valve that is mountable on a fuel filtration module having a fuel inlet and a fuel outlet, comprising:

a valve housing;

a thermal recirculation valve inlet formed in the valve housing that in use receives heated fuel from an engine;

a thermal recirculation valve outlet formed in the valve housing that is fluidly connected to the thermal recirculation valve inlet via a first fluid passage and that in use is fluidly connected to a fuel tank;

a fuel return passage formed in the valve housing, the fuel return passage having a fuel return passage inlet and a fuel return passage outlet, the fuel return passage inlet is fluidly connected to the first fluid passage, the fuel return passage inlet includes a valve seat, and in use the fuel return passage outlet is fluidly connected to the fuel outlet of the fuel filtration module;

a flow control valve disposed in the fuel return passage that controls flow of fuel through the fuel return passage, the flow control valve includes a sealing end; the flow control valve has a first position where the sealing end is engaged with the valve seat to control the flow of fuel from the first fluid passage into the fuel return passage and a second position where the sealing end is not engaged with the valve seat to permit unrestricted flow of fuel through the fuel return passage inlet from the first fluid passage into the fuel return passage and to the fuel return passage outlet; and a thermal wax element connected to the flow control valve to move the flow control valve between the first position and the second position, the thermal wax element is positioned so that in use the thermal wax element can be immersed in fuel in the fuel outlet of the filtration module.

2. The thermal recirculation valve of claim 1, further comprising a seal that seals between the flow control flow valve and the valve housing to prevent fuel in the fuel return passage from contacting the thermal wax element.

3. The thermal recirculation valve of claim 2, wherein the seal is disposed on the flow control valve between the sealing end and the thermal wax element.

4. The thermal recirculation valve of claim 1, wherein the fuel return passage outlet is positioned between the first fluid passage and the thermal wax element.

5. The thermal recirculation valve of claim 1, wherein the fuel return passage outlet has an axis that is disposed at approximately 90 degrees to an axis of the fuel return passage inlet.

6. The thermal recirculation valve of claim 1, wherein in use, the fuel return passage outlet is fluidly connected to a dirty side of a filter element in the fuel filtration module.

7. The thermal recirculation valve of claim 1, wherein the fuel return passage outlet is positioned closer to the fuel return passage inlet than to the thermal wax element.

8. The thermal recirculation valve of claim 1, wherein at the first position of the flow control valve, the sealing end is engaged with the valve seat to substantially prevent the flow of fuel from the first fluid passage through the fuel return passage inlet and into the fuel return passage.

9. A combination comprising:

a fuel filtration module having a fuel inlet, a fuel outlet, and a filter element that filters fuel as it flows from the fuel inlet to the fuel outlet;

a thermal recirculation valve mounted on the fuel filtration module, the thermal recirculation valve includes:

a valve housing;

a thermal recirculation valve inlet formed in the valve housing that in use receives heated fuel from an engine;

a thermal recirculation valve outlet formed in the valve housing that is fluidly connected to the thermal recirculation valve inlet via a first fluid passage and that in use is fluidly connected to a fuel tank;

a fuel return passage formed in the valve housing, the fuel return passage having a fuel return passage inlet and a fuel return passage outlet, the fuel return passage inlet is fluidly connected to the first fluid passage, the fuel return passage inlet includes a valve seat, and the fuel return passage outlet is fluidly connected to the fuel outlet of the fuel filtration module;

a flow control valve disposed in the fuel return passage that controls flow of fuel through the fuel return passage, the flow control valve includes a sealing end; the flow control valve has a first position where the sealing end is engaged with the valve seat to control the flow of fuel from the first fluid passage into the fuel return passage and a second position where the sealing end is not engaged with the valve seat to permit unrestricted flow of fuel through the fuel return passage inlet from the first fluid passage into the fuel return passage and to the fuel return passage outlet; and a thermal wax element connected to the flow control valve to move the flow control valve between the first position and the second position, the thermal wax element is positioned so that the thermal wax element is disposed in the fuel outlet of the filtration module so that the thermal wax element can be immersed in fuel in the fuel outlet.

10. The combination of claim 9, further comprising a seal that seals between the flow control flow valve and the valve housing to prevent fuel in the fuel return passage from contacting the thermal wax element.

11. The combination of claim 10, wherein the seal is disposed on the flow control valve between the sealing end and the thermal wax element.

12. The combination of claim 9, wherein the fuel return passage outlet is positioned between the first fluid passage and the thermal wax element.

13. The combination of claim 9, wherein the fuel return passage outlet has an axis that is disposed at approximately 90 degrees to an axis of the fuel return passage inlet.

14. The combination of claim 9, wherein the fuel return passage outlet is fluidly connected to a dirty side of the filter element in the fuel filtration module.

15. The combination of claim 9, wherein the fuel return passage outlet is positioned closer to the fuel return passage inlet than to the thermal wax element.

16. The combination of claim 9, wherein at the first position of the flow control valve, the sealing end is engaged with the valve seat to substantially prevent the flow of fuel from the first fluid passage through the fuel return passage inlet and into the fuel return passage.

17. The combination of claim 9, wherein the flow control valve has a longitudinal axis that is substantially perpendicular to a longitudinal axis of the filter element.

* * * * *